United States Patent [19]

Reveen

[11] Patent Number: 5,015,211

[45] Date of Patent: May 14, 1991

[54] CONFETTI CANNON

[76] Inventor: Tyrone J. Reveen, 12B Sunset Way, #208, Henderson, Nev. 89014

[21] Appl. No.: 188,537

[22] Filed: Apr. 29, 1988

Related U.S. Application Data

[63] Continuation-in-part of Ser. No. 940,866, Dec. 12, 1986, abandoned.

[51] Int. Cl.[5] ..... A63H 33/30; A63H 37/00

[52] U.S. Cl. ..... 446/475; 124/74

[58] Field of Search ..... 446/176, 181, 186, 211, 446/475; 124/74, 76

[56] References Cited

U.S. PATENT DOCUMENTS 2,725,048 11/1955 Koogle ..... 124/74 X
2,756,737 7/1956 Resch, Jr. ..... 446/211 X
3,204,625 9/1965 Shepherd ..... 124/74
3,382,859 5/1968 Myers ..... 124/74
4,531,503 7/1985 Shepherd ..... 124/76

*Primary Examiner*—Mickey Yu
*Attorney, Agent, or Firm*—Quirk, Tratos & Roethel

[57] ABSTRACT

A portable, light-weight confetti cannon for projecting confetti to heights of 30–40 feet in the air is used to create spectacular displays for rock concerts or stage shows. The cannon consists of a hollow barrel having a length of at least 3 feet and a length/diameter ratio of at least 20 having a $CO_2$ cartridge radially mounted at its base. The cartridge is covered by an insulated grip. A valve is mounted between the cartridge and the barrel and has a cartridge puncturing mechanism which enables complete discharge of $CO_2$ cartridge contents in less than three seconds.

12 Claims, 4 Drawing Sheets

CONFETTI CANNON

RELATIONSHIP TO OTHER CASES

This application is a continuation-in-part of application Ser. No. 940,866, filed Dec. 12, 1986, entitled Confetti Cannon, now abandoned.

BACKGROUND OF THE INVENTION

This invention relates to a device for creating a spectacular visual effect for stage shows, rock concerts, and the like. More particularly, it relates to a light-weight, small, portable device capable of discharging an explosion of confetti to heights of forty feet or above in a sudden burst.

The success of stage spectaculars, such as rock concerts, large stage shows, and other "happenings" is often dependent in part upon the visual effects which are portrayed upon the stage. Performing groups and Las Vegas-type stage shows often spend hundreds of thousands of dollars to create visual extravaganzas in an effort to create an exciting atmosphere for performers. Lighting effects, lasers, water fountains, and spectacular scenery are often used.

The present invention provides a method of discharging large quantities of confetti high into the air in an explosive manner, creating a visually spectacular shower effect. The confetti, glitter, or other loose material may be propelled to a height of up to forty feet or more into the air, from where it descends slowly to create a remarkable effect. The present invention provides a light weight, portable cannon, which is reuseable and is capable of carrying its own self-contained explosion charge to propel the contents into the air. Because of the amount of material to be displayed and the height that it must be lifted, the device takes full advantage of and maximizes the efficiency of the available charge. In general, the device consists of an elongated tubular barrel which contains the objects to be discharged, with a disposable $CO_2$ cartridge mounted in a grip member at one end thereof. The cartridge has a puncturing mechanism which enables a substantially instantaneous discharge of the contents of the cartridge (i.e., in less than about two seconds), thereby providing an explosive discharge to the contents of the tube.

In the past, apparatus for discharging large amounts of lightweight objects into the air for commercial settings have used large tanks of compressed air and have barrels with a relatively low length-to-diameter ratio. These devices are expensive and cumbersome, since they are not easily transported. After use, the entire compressed air tank must be refilled, thus requiring the use of an air compressor. In addition, it is more difficult to hide these bulky pieces of equipment in a scenery set.

Other known prior art devices have been used to propel confetti or coiled paper have generally been limited to use by individuals at parties, such as birthdays and New Years Eve celebrations. These devices have been employed to propel either long strips or small pieces of paper into the air, and are small, hand-held, inexpensive, and discarded after a one-time use. Examples of such devices are the explosive charge activated by a hand-pulled string, as in the Kliemant patent, U.S. Pat. No. 825,843, or by means of a lighted fuse as shown in the Craig patent, U.S. Pat. No. 1,664,401. In Eisenberg, U.S. Pat. Nos. 1,153,207, and Macchia, 1,441,809, the propelled media is forced into the air by blowing with a person's mouth into an orifice. Rutherford, U.S. Pat. No. 1,560,326 shows a similar product using bellows to discharge the product. Resch, U.S. Pat. No. 2,756,737 contemplates the use of a manually operated piston or a compressed gas cylinder to propel a cartridge of a coiled streamer from inside a barrel by directing a fluid stream through the center of the cartridge. The Resch patent differs from the device of the invention in that the invention comprises a cannon having a long barrel into which the material to be discharged is packed as a plug, and is discharged in an explosive manner when the contents of the $CO_2$ cartridge are released.

Accordingly, it is the object of this invention to provide a relatively small, portable, rechargeable cannon for explosively discharging lightweight objects into the air. It is another object of the invention to provide a propelling device whereby confetti can be loaded and packed into a barrel abutting a gas discharge orifice. It is a further object of the invention to provide a device that can instantaneously and suddenly discharge the contents of its gas cylinder charge into the barrel. Yet a further object of the invention is to provide a barrel having dimensions adequate to hold a relatively large amount of medium to be discharged, while providing the proper discharge characteristics to achieve a substantial vertical height upon explosion. These and other objects are accomplished by means of the invention, a preferred embodiment of which is disclosed herein.

BRIEF SUMMARY OF THE INVENTION

A propulsion device for projecting confetti to heights in excess of 30–40′ into the air comprises a barrel having a length of at least 3′, and preferably 4′, and a length-/diameter ratio of at least 20 and preferably 30. Propulsion means comprising a small disposable $CO_2$ cartridge is mounted at a lower end of the barrel; in a preferred embodiment, the cartridge is mounted radially to the barrel, and is contained inside an insulative sleeve which also serves as a grip. A trigger which also includes a cartridge puncturing pin fabricated to substantially instantaneously release the cartridge content is mounted at a lower end of the barrel.

DETAILED DESCRIPTION OF A PREFERRED EMBODIMENT

The confetti cannon of the invention is a device that discharges confetti high into the air by utilizing compressed $CO_2$ contained in a small cylinder as the propulsion medium.

Figure 1:
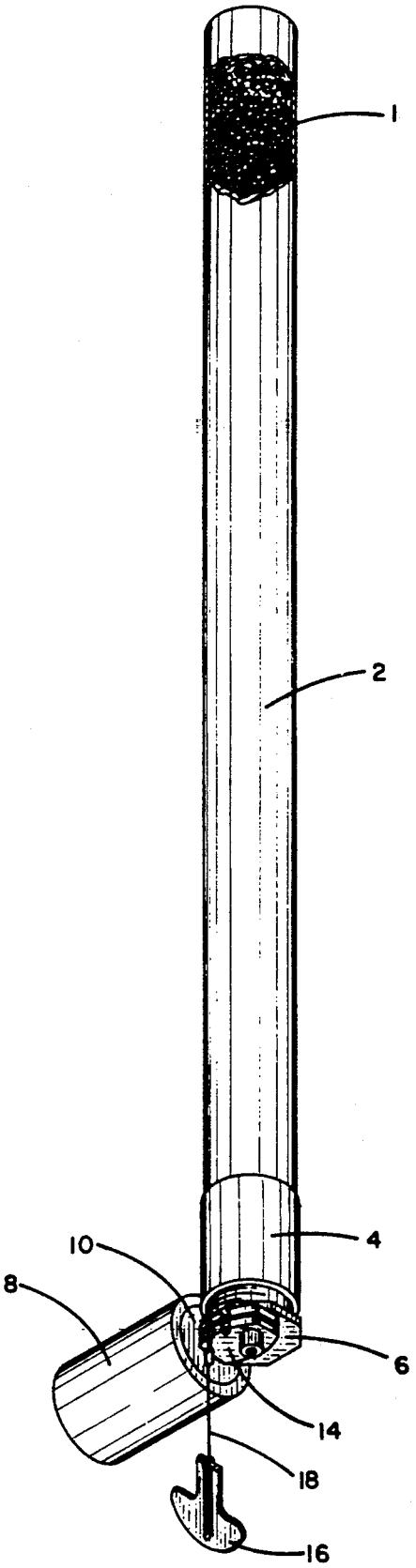
FIG. 1 is a perspective view of the confetti cannon of the invention.

The configuration of the cannon is shown in FIG. 1. It consists generally of a hollow cylindrical barrel 2, packed with confetti 1, an insulated grip 8 extending radially from the base of the barrel and containing a $CO_2$ cartridge, and a release valve 14 for substantially instantaneous release of the cartridge contents. The term "confetti" as used herein refers to quantities of very small particulate paper or plastic in the form of discrete colored disks. Hundreds of these disks can be packed into a volume of less than a cubic inch, yet will scatter in a shower to provide a pleasing visual effect.

Figure 2:
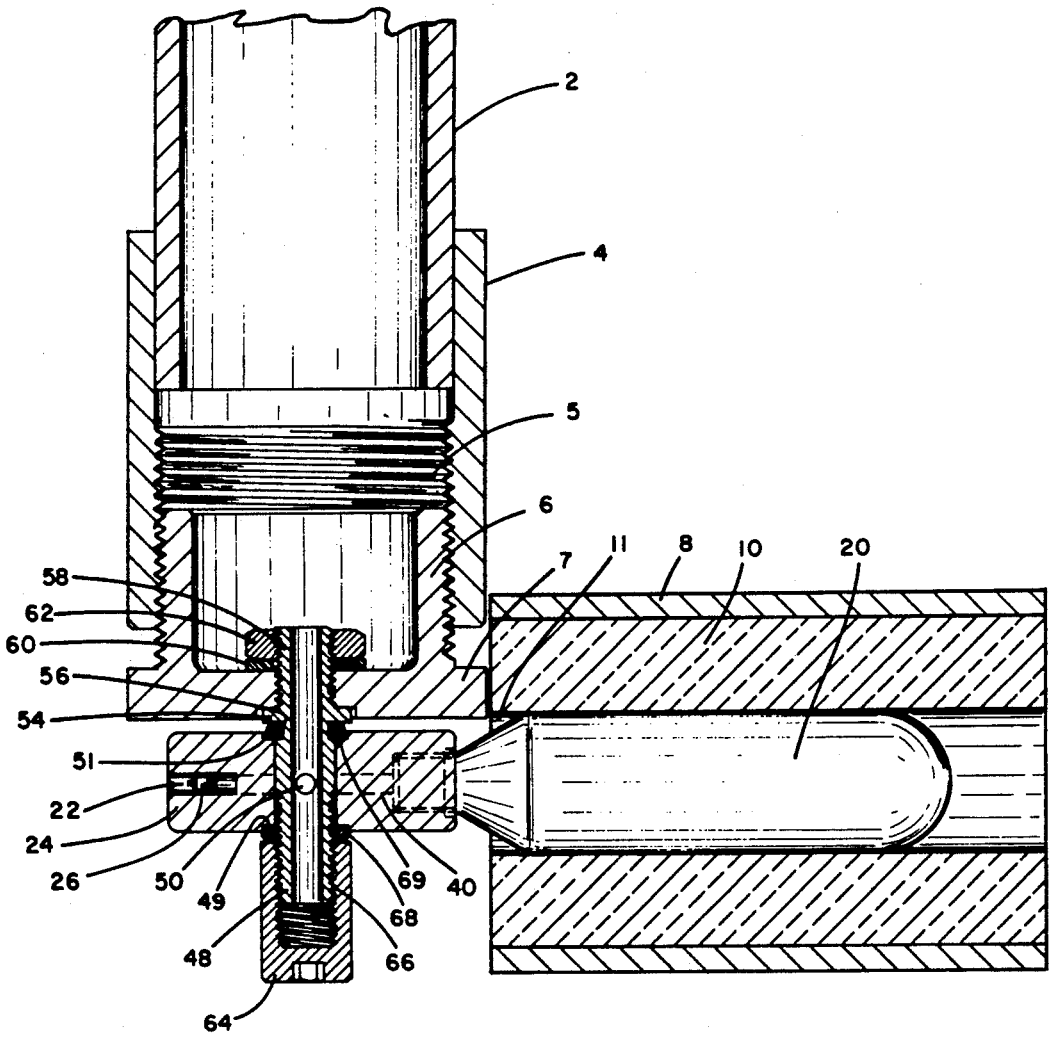
FIG. 2 is a cross-sectional view of the confetti cannon as viewed from the top.
Figure 3:
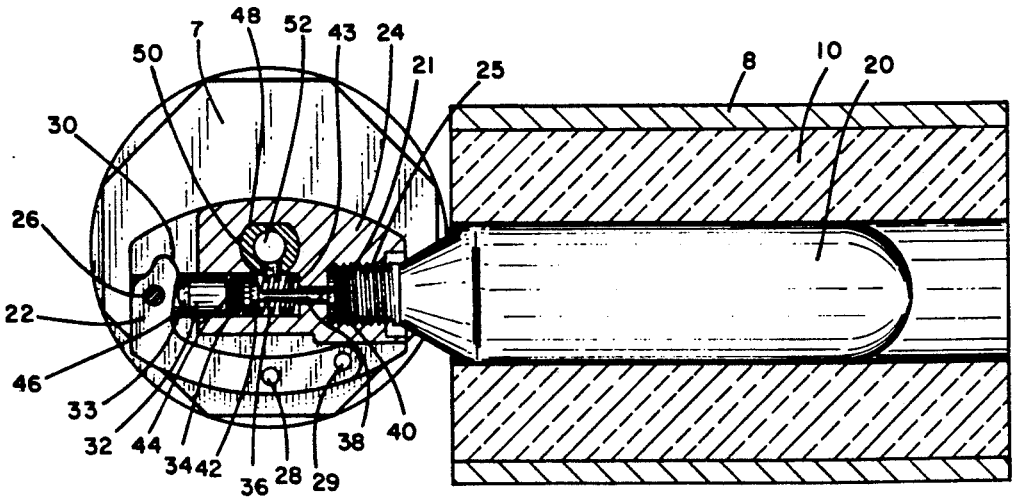
FIG. 3 is a cross-sectional view of the confetti cannon as viewed from the end.

More specifically, the internal workings of the valve assembly are shown in FIGS. 2 and 3. A disposable $CO_2$ cartridge or cylinder 20 is screwed into threads 25 of valve housing 24 until the it "seats" against valve shoulder 21. Plunger pin 38 is permanently fixed in plunger 32 and both can move along the axis of bores 40 and 33 respectively. Helical compression spring 36 is located in bore 40 and is held captive on one end by shoulder 43 of housing 24 and on the other end by shoulder 42 on plunger 32. The spring-biased plunger 32 and the sharp, tapered end of plunger pin 38 away from cylinder 20. Lever 22 pivots on pin 26 and can be activated by a cord or other linkage attached to either holes 28 or 29. When lever 22 is activated, cam surface 30 contacts striking surface 46 of plunger 32, overcoming the force exerted by spring 36 and moves the plunger and plunger pin toward the cylinder.

The valve 14 is a standard, commercially available device such as Roberts® 840 AM series, and is manually actuated by pulling pull-tab 16 attached to lanyard 18 (see FIG. 1). The lanyard is fastened by crimp clamp 19. These valves are commonly used to inflate life jackets, and have a puncturing mechanism designed to release the contents of a $CO_2$ cartridge substantially instantaneously. By "substantially instantaneously" is meant the total release of the contents of a 12-gram $CO_2$ cartridge in less than about 2 seconds, preferably less than 1½ seconds, and still more preferably less than one second. A slower release will not provide the explosive projectile effect required of the cannon.

The sharp end of plunger pin 38 punctures cylinder 20 and releases the $CO_2$ gas into bore 40. Since plunger pin 38 is hollow and slotted along its length, the gas from cylinder 20 presses into bore 33, through valve hole 50, and finally out valve passageway 52, contacting the compacted confetti inside barrel 2 and exploding it out the end of the barrel (see FIG. 2 and FIG. 3). O-ring 34, shown in FIG. 3, is located in groove 44 of plunger 32 and prevents gases from escaping around plunger 32 and out of the end of bore 33. Valve 48, shown in FIG. 2, directs the gas flow from the housing 24 into barrel 2 and is also used to attach the housing 24 to PVC nut 6. As shown in FIG. 2, housing 24 slips over valve 48 and is secured by brass cap 64 screwed onto threaded nipple 66 of connecting valve 48. The inner seal is accomplished by O-ring 69 located in valve groove 56 sealing on the inside flange 54 and on the outside against seat 51. The outer seal is accomplished by O-ring 68 sealing on the inside against seat 49 and on the outside against cap 64. Nut 6 having flange 7 is slipped over valve 48 until it abuts flange 54. Washer 60 is installed and nut 62 is screwed onto threads 58 until tight. Coupling 4 is joined to nut 6 by threads 5 and coupling 4 is joined to barrel 2 by a glued slip-fit joint. The nut, coupling and barrel are standard 1½" PVC but can be constructed from other materials as required.

The length and diameter of the barrel are important as they critically affect the confetti "flow pattern". Although barrel lengths of at least about 30", preferably from about 36" to about 60", can be used, the optimum length has been found to be about 48". Likewise, an inside diameter of 1½" has been found to be ideal. If other media are discharged, the length can vary depending on the effect. It has been found that in order to enable the plug-type discharge necessary to achieve the desired effect of the cannon of the invention, the barrel has a length/diameter ratio of at least 20, and preferably at least about 30. Length/diameter ratios exceeding about 60 are not desirable since a desired shower effect is not obtained; at these higher length/diameter ratios the contents tend to travel more as a plug. The term "length/diameter ratio" assumes that the barrel has a circular cross-section; if the cross-section is other than circular, the length/diameter ratio can be replaced by the length/cross-sectional area ratio, using a circular cross-section for conversion of the length/diameter ratio. The term "diameter" refers to inside diameter.

Figure 4:
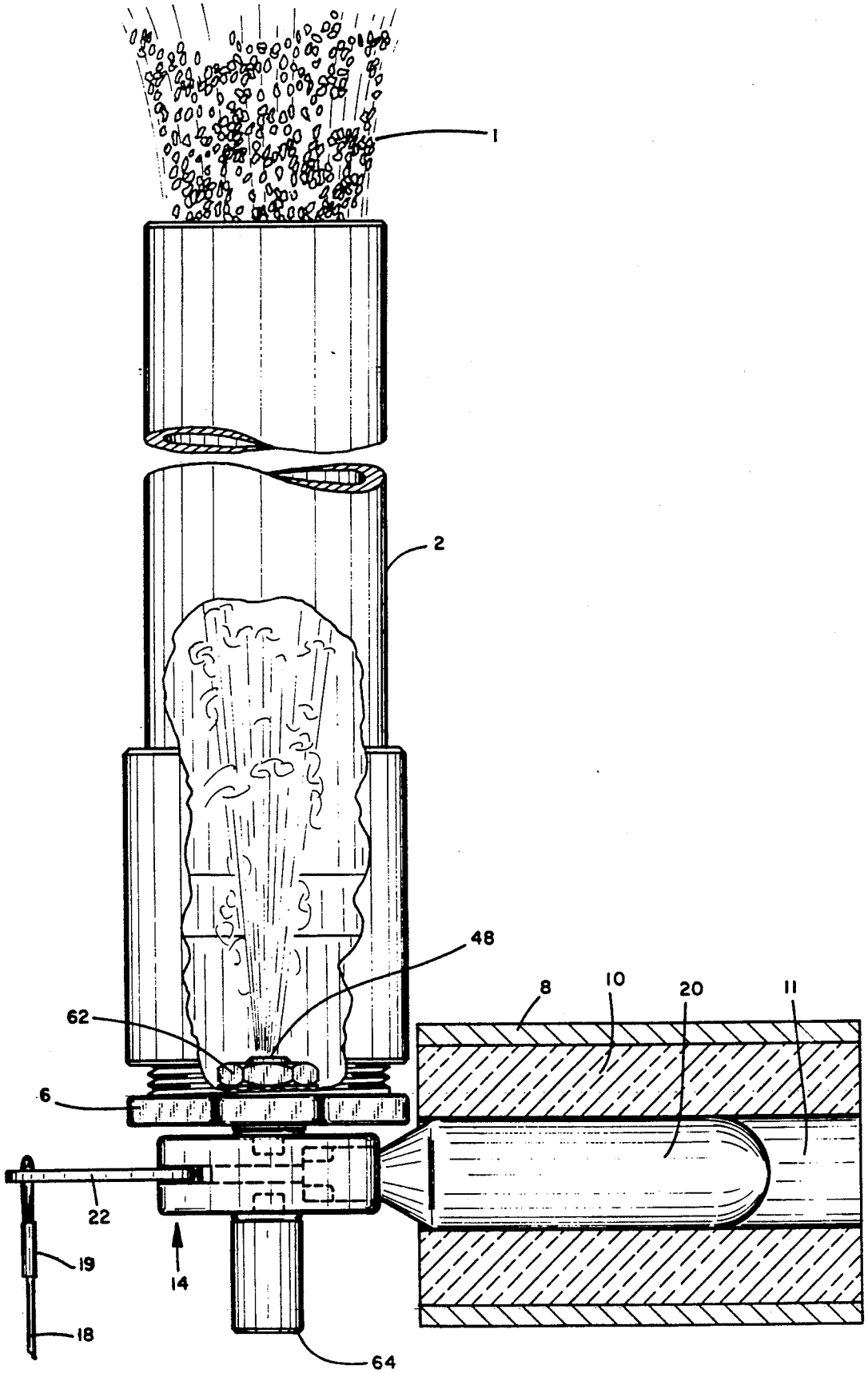
FIG. 4 is a top view of the confetti cannon, with a cutaway of the barrel showing the confetti being discharged.

As seen in FIGS. 1 and 4, the $CO_2$ cartridge 20 is mounted radially at the base of the cannon, and threadedly engages valve 14. The cartridge is maintained within an insulated grip 8 having an annular ring of foam insulation material 10. The insulation has an axial bore 11 into which the cartridge fits slideably and is maintained by friction. FIG. 4 also shows the cannon in discharge mode. The lever arm 22 is shown in actuated position, with the $CO_2$ contents of the cartridge being discharged into the base of the barrel 2. Confetti ejects from the top of the cannon, generally in relatively plug-type flow, exploding to heights of up to 40 feet.

$CO_2$ cartridges are readily available, and are manufactured by Leland of Japan and Germany or Crossman. In order to provide adequate force for the explosion of the cannon, a cartridge having a net weight of at least 8 grams, and preferably at least 16 grams, is necessary; cartridges of over 24 grams are unnecessary although they can be used.

The materials of construction of the cannon as shown in FIGS. 1–4 are conventional. Housing 24 is PVC plastic; plunger pin 38 is stainless steel; spring 36, lever 22 and pivot pin 26 are steel; plunger 32 is aluminum and the valve 48, cap 64, and nut 62 are brass. O-rings 34, 68 and 69 are rubber and 68 and 69 can be flat if desired.

Operation of the cannon can be seen by referring to FIG. 4 where 1½ to 2 lbs. of confetti 1 is packed and tamped into barrel 2 compacting its volume by some 40%. Next, $CO_2$ cartridge 20 is screwed into release valve 14 and insulation sleeve 8 containing insulation material 10 is slipped over the $CO_2$ cartridge (this sleeve is necessary to protect the hands and body from freezing when the $CO_2$ gas is discharged from cylinder 20). The cannon is activated by pulling cord 18 which is attached to lever arm 22 thereby releasing the contents of cylinder 20 through valve 48. The $CO_2$ gas instantly and suddenly explodes the confetti spectacularly into the air some 30–40' or more in a flower or cone-shaped pattern.

Figure 5:
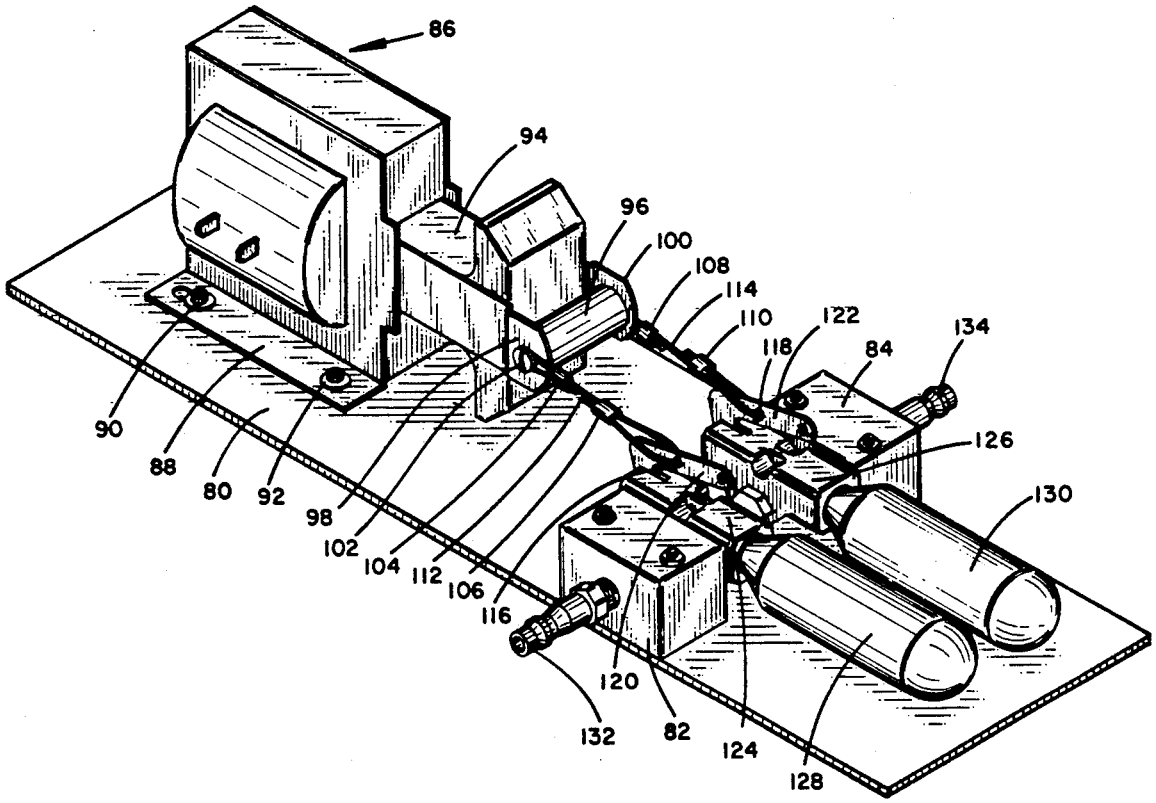
FIG. 5 is a perspective view of a dual automatic confetti cannon system triggered by a solenoid.

An alternate embodiment of the release mechanism of the invention is shown in FIG. 5. This mechanism is used for automatic actuation of one or two cannons electrically during a show or other spectacular event. A solenoid actuator 86 is mounted on a base 80 by screws 90 and 92 extending through a flange 88 at a lower portion of the solenoid. A pair of valve housings 82 and 84 are mounted at a forward portion of the base. A pair of quick coupling devices 132 and 134 extend laterally outwardly from the mounting blocks and are connected to cannons of the invention by means of short air hoses (not shown). $CO_2$ cartridges 128 and 130 are mounted in valve housings 124 and 126 which are attached to the valve mounting blocks 82 and 84. The valves are conventional Roberts® valves as previously identified.

The valve actuating mechanism consists of a slideable arm 94 which is actuated by the solenoid 86. The arm has a pair of spaced parallel flanges 98 and 100 separated by a spacer 96. A pair of wire linkages 112 and 114 extend between the flanges 98 and 100 and the lever arms 120 and 122 which actuate the valves. The wires 112 and 114 extend through bores 116 and 118, respectively, in lever arms 120 and 122, and are fastened by means of clamps 106 and 110. At the other ends, the connecting wires 112 and 114 loop around a screw 102 which extends through the flanges 98 and 100, and are fastened by means of clamps 104 and 108. Upon actuation of the solenoid, either by means of a manual electric switch or a clock, two cannons of the invention may be set off simultaneously on stage.

An important feature of the invention is that the chamber and passageways extending between the $CO_2$ cartridge and the interior of the barrel of the cannon are air tight and completely sealed. First of all, if the cannon is used to discharge water into the air, it is obviously important that the barrel and valve mechanism be fluid tight to prevent leakage of the water. In addition, the cannon must be maintained sealed to any gas leaks to preclude diminishing the explosive force of the cartridge upon release. Should pressurized gas leak out of the valve upon discharge, the projectile force will be decreased, and the desired effect will not be obtained.

The invention has been described with respect to several specific embodiments thereof, but persons skilled in the art will recognize that a number of additions and modifications to the invention as described may be made without departing from its spirit and scope. Accordingly, the invention should not be considered limited by the foregoing description of embodiments thereof, but rather should be limited only by the following claims.

I claim:

1. A confetti propulsion device for exploding a plug of particulate confetti packed into the device comprises a barrel having a length of at least 3′ and a length/inside diameter ratio of from at least 20 to about 60, propulsion means comprising a sealed $CO_2$ cartridge mounted at a lower end of the barrel, valve means operatively connected to the propulsion means for releasing the contents of the $CO_2$ cartridge substantially instantaneously, and trigger means for actuating the valve means.

2. The propulsion device of claim 1 wherein the barrel has a length of at least about 4′.

3. The propulsion device of claim 1 wherein the barrel has a length/diameter ratio of at least about 30.

4. The propulsion device of claim 1 wherein the $CO_2$ cartridge is mounted perpendicularly to the longitudinal axis of the barrel such that the cartridge discharges into a lower portion of the barrel.

5. The propulsion device of claim 1 also comprising grip means perpendicularly mounted at a lower portion of the barrel, and wherein the $CO_2$ cartridge is mounted interiorly of the grip means.

6. The propulsion device of claim 1 also comprising grip means perpendicularly mounted at a lower portion of the barrel perpendicular thereto, said grip means having a circular cross-section and having the $CO_2$ cartridge mounted therein, and also comprising insulation means mounted between the $CO_2$ cartridge and the grip means.

7. The propulsion device of claim 1 also comprising confetti packed into the barrel along substantially its entire internal length.

8. The propulsion device of claim 1 wherein the valve means comprises means for puncturing the $CO_2$ cartridge such that the entire contents of the $CO_2$ cartridge are discharged within about 2 seconds.

9. The propulsion device of claim 1 wherein the valve means comprises puncturing means for piercing the $CO_2$ cartridge, said puncturing means comprising a slotted hollow pin.

10. The propulsion device of claim 1 wherein the $CO_2$ cartridge contains from about 8 to about 20 grams of $CO_2$.

11. In combination, a confetti propulsion device for exploding a plug of particulate confetti packed into the device comprises a barrel having a length of at least 3′ and a length/inside diameter ratio of from at least 20 to about 50, propulsion means comprising a sealed $CO_2$ cartridge mounted at a lower end of the barrel, valve means operatively connected to the propulsion means for releasing the contents of the $CO_2$ cartridge substantially instantaneously, and trigger means for actuating the valve means, and a compressed mass of particulate confetti mounted in the barrel of the device.

12. The combination of claim 11 wherein the compressed mass comprises at least 1.5 pounds of confetti.

* * * * *